United States Patent [19]

Baum

[11] Patent Number: 5,023,820

[45] Date of Patent: Jun. 11, 1991

[54] SYSTEM FOR MONITORING ROLL DENSITY

[75] Inventor: Scott A. Baum, Rockton, Ill.

[73] Assignee: Beloit Corporation, Beloit, Wis.

[21] Appl. No.: 349,629

[22] Filed: May 10, 1989

[51] Int. Cl.[5] ..... G06F 15/20

[52] U.S. Cl. ..... 364/562; 364/469; 364/471; 377/24

[58] Field of Search ..... 73/32 R, 78; 242/54 R, 242/55.1; 364/468, 469, 470, 471, 472, 558, 562; 377/2, 15, 24, 26

[56] References Cited

U.S. PATENT DOCUMENTS

| | | | |
|---|---|---|---|
| 3,564,219 | 2/1971 | Mutziger | 364/562 X |
| 3,898,436 | 8/1975 | Pottebaum et al. | 377/2 |
| 4,052,599 | 10/1977 | Whiteley et al. | 364/562 X |
| 4,151,403 | 4/1979 | Woolston | 242/58.1 X |
| 4,335,439 | 6/1982 | St. Denis | 364/472 X |
| 4,422,588 | 12/1983 | Nowisch | 242/66 X |
| 4,535,950 | 8/1985 | Lisnyansky | 242/66 |

*Primary Examiner*—Parshotam S. Lall
*Assistant Examiner*—Edward R. Cosimano
*Attorney, Agent, or Firm*—Dirk J. Veneman; Raymond W. Campbell; Gerald A. Mathews

[57] ABSTRACT

Separate density profiles are obtained for each station of a multi-station winder. The technique requires a single processor for simultaneously monitoring the density of any number of rolls being wound. The density may also be monitored for the unwind roll for determination of roll structuring changes by a winder. A simple system is provided in which each of the rolls is provided with an encoder. The encoder of a center roll of fixed diameter produces a fixed number of pulses per revolution representing paper length and the pulses produced by the encoders of each of the winding stations are counted along with the pulses produced by the winder of the center fixed diameter roll for computing density from roll and angular parameters and basis weight.

7 Claims, 3 Drawing Sheets

HOLD REGISTER
COUNTER
LOAD REGISTER
COUNT = J?
NO
YES
MEMORY
CONSTANTS STORAGE
PROGRAM STORAGE
BUFFER
INTERRUPT (RESET)
CALCULATION CIRCUITS
DISPLAY AND LOG TO MEMORY
PROCESSOR
INTERRUPT LEVEL
64
62
44"
66
60
68
70
72
76
80
78
74
64a
62a
46"
66a
60a
64b
62b
48"
66b
60b
64c
62c
50"
60c
66c
82
64d
62d
52"
60d
66d
84
64e
62e
54"
60e
66e
64f
62f
56"
60f
66f

SYSTEM FOR MONITORING ROLL DENSITY

BACKGROUND OF THE INVENTION

1. Field of the Invention

The present invention relates to monitoring roll density, and is more particularly concerned with monitoring the density of a plurality of paper rolls as they are simultaneously but individually, wound on respective winding rolls.

2. Description of the Prior Art

Heretofore, an encoder has been mounted to one of the drums of a two drum winder and a proximity switch is mounted to the core of one of the rotating rolls. In order to determine density, the pulses from the drum encoder are counted for a predetermined number of revolutions of the wound roll, as established by the once per revolution pulse of the proximity switch. The roll diameter can be calculated and the footage of paper can be calculated based on a multiple of paper roll revolutions. Armed with the basis weight of the paper, the diameter change and the added footage of paper, the incremental density added to the roll can be determined. It should be noted that herein the term "drum" is reserved for a center rotating device between an unwinding station and one or more winding stations and which guides a moving web, while the term "roll" is employed for a rotating device which is winding a web and "roll" is used for a rotating device which unwinds a web.

The foregoing method presents two problems when applied to monitoring of more than one roll. First of all, in order to monitor the density of more than one roll of paper, all rolls must together rotate at the same number of revolutions per minute. For a two drum winder, this is not a serious problem since all rolls rotate at approximately the same rate. The density calculated, however, only holds true for the roll directly connected to the proximity switch. A biwind winder, for example, because of its design, could have each roll rotating at substantially different rates. In order for the current systems to be used on a biwind winder, the processor would have to simultaneously service more than one interrupt, or separate processors would be required for each roll to be monitored.

Another problem is that a system of this type calculates density based on a whole number of roll revolutions which means that the roll diameter as paper is added to the roll is not constant, but slightly changes for each sampling period. The time between sampling periods also increases as the paper roll diameter increases for a constant winder speed. Because all rolls may not be rotating at the same speed and because the time between sampling periods increases, these two factors lead to a non-uniform sheet length density determination.

SUMMARY OF THE INVENTION

An object of the present invention is to provide a system for simultaneously monitoring and providing separate density profiles for each roll of a multistation winder.

The above object is achieved, according to the present invention, by the provision of a density monitor which calculates paper roll density based on a constant footage of paper passing a fixed diameter drum. Each roll or drum, including an unwind drum, the fixed diameter drum and the wind-up rolls, is provided with an encoder which produces pulses as the rolls rotate. Each of the encoders is connected to a counter which counts the revolutions of the respective roll.

The fixed diameter drum, or central roll, along with its counter, causes the production of an interrupt which initiates processing of the data collected by the counters. Simply, the system reads the value of all counters each time a set footage of paper passes the central drum of a winder. In this case, the system interrupt is moved from a set number of paper roll revolutions as was heretofore done to a set angular revolution of the central drum.

More specifically, the encoders are mechanically connected to the rolls such that a constant number of counts are provided for the respective counter for each revolution of the roll. Therefore, each roll does not cause the production of the same number of counts as each of the other rolls.

The encoders are preferably isolated from the processor or computer for safety by incorporating electro-optical, optical electrical converters to protect the counters. For example, the converters may limit the signals to the counters to a 5 volt square wave. Also, the outputs may be in quadrature (multiplied) for increased resolution.

Preferably, the counters are buffered to store the value of the previous count while the counter is accumulating new data. Such buffering may occur by way of a memory of the processing computer.

The encoder connected to the central drum functions as the single hardware interrupt for signaling all counters to simultaneously reset and start counting over. This interrupt also signals the processor to read each buffered output of the previous count for each of the rolls.

The use of the encoder, rather than a proximity switch, on the central drum provides that the density can be determined for any desired length of paper since there is no longer a requirement for a whole number of drum revolutions for calculation. The drum diameter is fixed and the density determinations can always be made at constant sheet length intervals. This provides for system accuracy by allowing the counters to be used more effectively since the time between successive readings will be constant for constant winder speed.

Inasmuch as only one interrupt is used, additional stations can be provided by adding additional encoders and counters. The number of stations which can be serviced is limited only by the memory of the processor used to store the information.

The invention may also be applied to a conventional two drum winder, as well as a multistation winder, to calculate the unwind density in order to detect winder-produced structuring changes.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
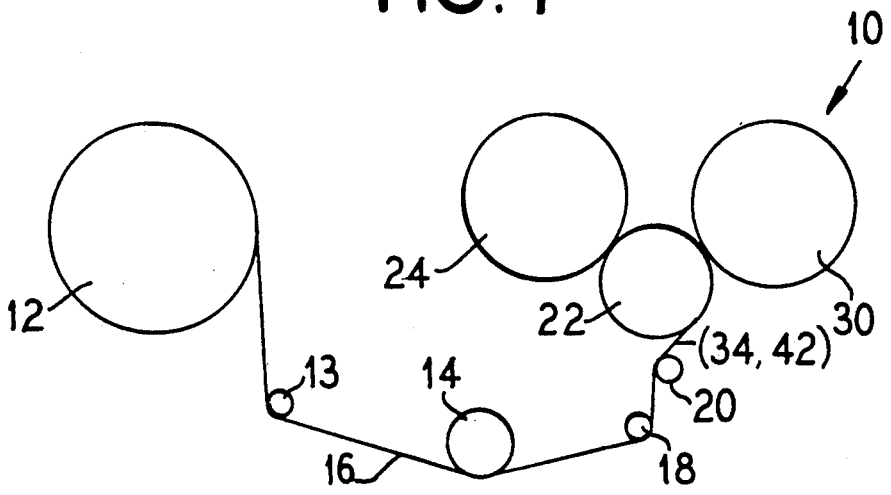
FIG. 1 is an end view of a multi-station winder.
Figure 2:
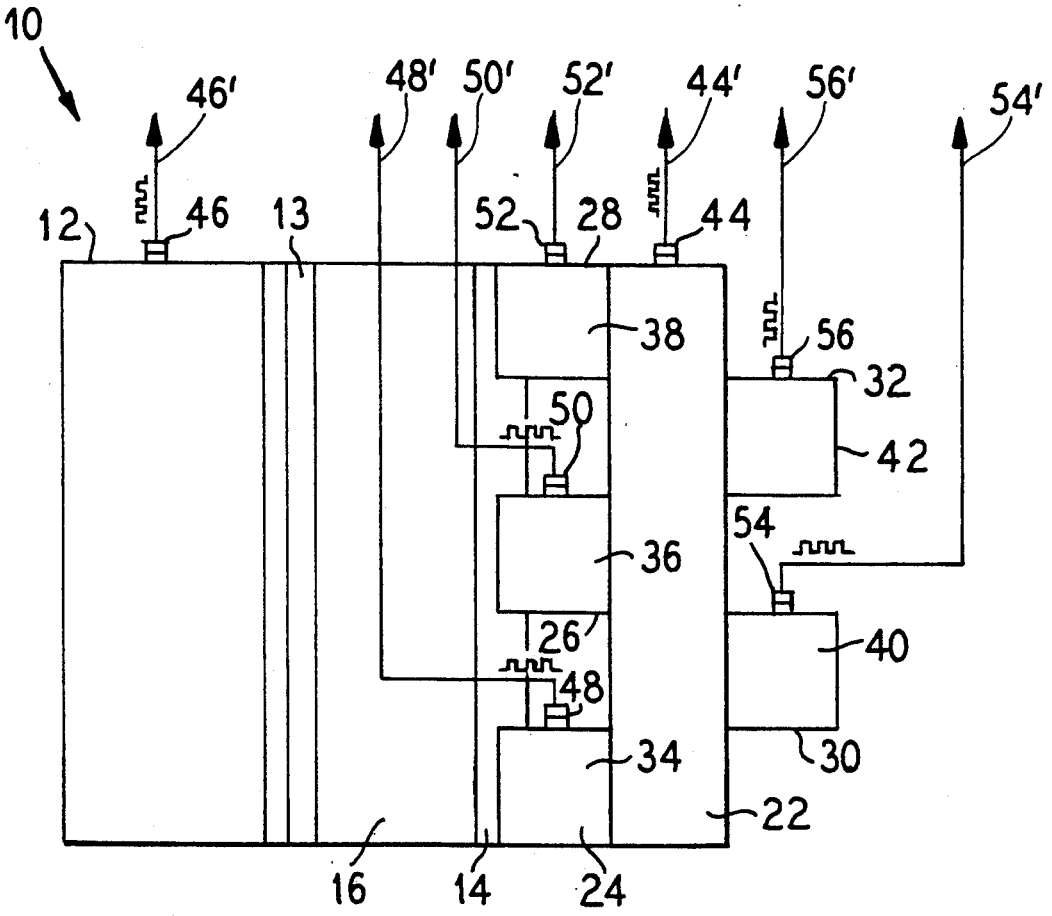
FIG. 2 is a top view of the multi-station winder of FIG. 1 showing an unwind drum, a central, and a plurality of windup rolls.

Referring to FIGS. 1 and 2, a multistation winder is generally illustrated at 10 as comprising an unwind reel 12, a pair of rotating guides 13 and 14, a slitter symbolically illustrated at 18 and 20, a center drum 22 of fixed diameter, and a plurality of windup rolls 24–32. A web 16 is slit into a plurality of narrower webs 34–42 which are guided by the center drum 22 to be wound on respective rolls 24–32. In FIG. 2, the narrower webs are illustrated as the last wrap 34–42 on the rolls 24–32.

According to the invention, the center drum 22 is provided with an encoder 44 and the unwind roll is provided with an encoder 46. The rolls 24–32 are provided with respective encoders 48–56. One may refer to the article by Charles Hudson entitled "A guide to optical shaft encoders . . . tachometers, incremental encoders and absolute position encoders", Instruments & Control Systems, May 1978, for a review of different types of encoders. The encoders used herein include circuitry which is well known in the art for multiplying the original signal by a factor, two or four, for example for increasing resolution.

Figure 3:
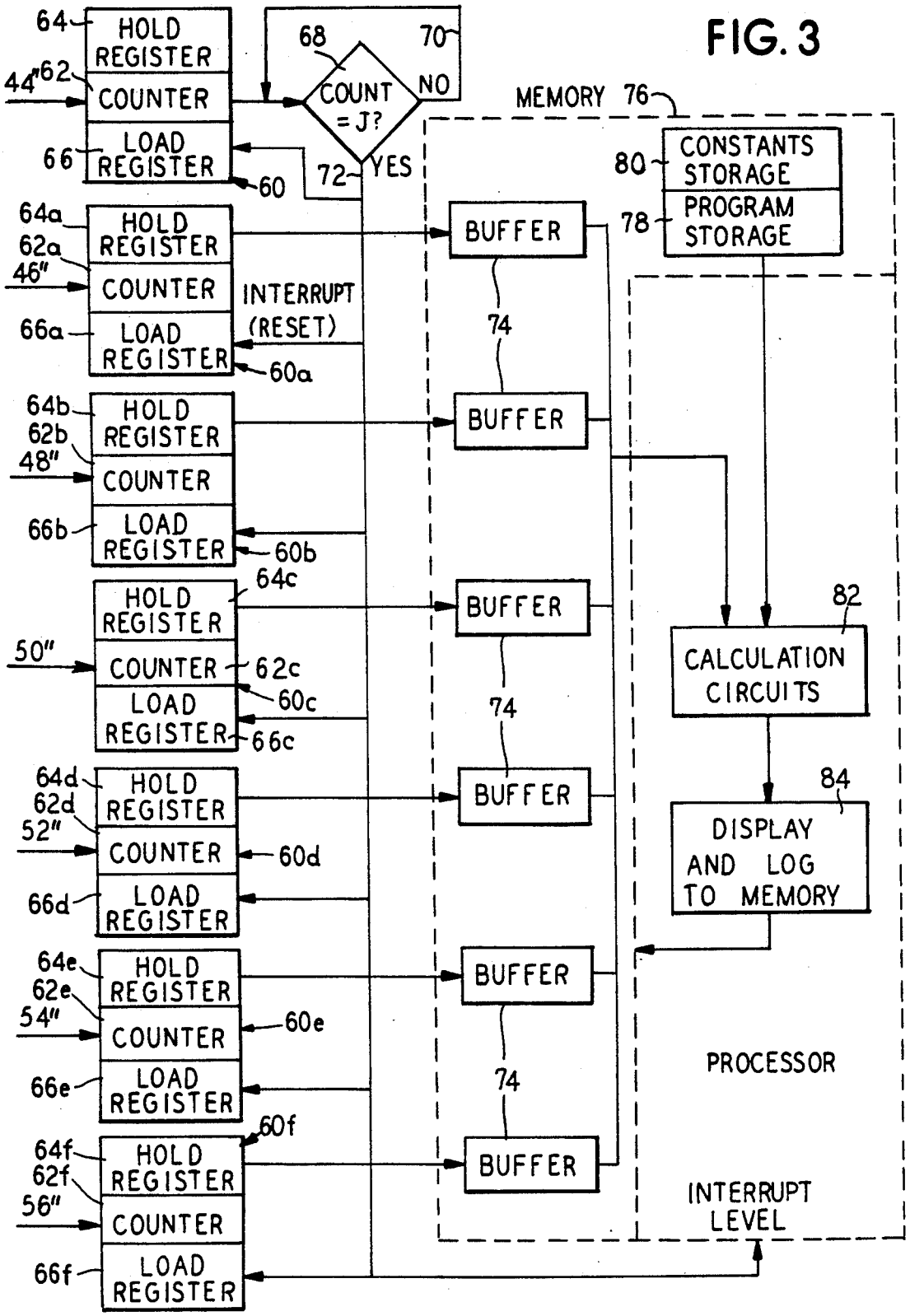
FIG. 3 is a schematic representation of apparatus for determining roll density in accordance with the present invention.

In the description, particularly with reference to FIGS. 2 and 3, related elements are designated with the same numeral, but with different prime superscripts. Thus, for example, encoder 44 produces an output signal 44′ which is received as an input signal 44″ by counting device 60. Similarly, corresponding elements are designated with the same numeral, but with different letter suffixes to distinguish them.

Optical isolation is also provided and considered to be included within the encoders.

The encoders provide respective output signals 44′–56′ which are fed to the calculating apparatus of FIG. 3.

The outputs of the encoders are provided as input signals 44″–56″ (FIG. 3) to respective station counting devices 60, each of which includes a counter 62, a hold register 64 and a load register 66. All of the counter devices are the same and may be provided, for example, by a symbolically illustrated multi-function counter/-timer such as the CTM-05 counter/timer card of Metra Byte Corp. 440 Myles Standish Blvd., Taunton, Ma. 02780. This is a plug-in circuitboard which is a digital I/O expansion for the IBM Personal Computer and is based on the AM9153 System Timing controller. It provides five, sixteen bit up/down counters and a 1M Hz crystal timebase with a divider and separate general purpose 8 bit TTL input and output ports. In the present example, the device is used to operate in the Mode Q.

In one embodiment the uppermost counting device 60 does not use the load register 66 and the hold register 64 in the present example in that this device is used for producing the interrupt. Each of the other counting devices, however, use the load register and the hold register, as will be apparent from the description below.

In another embodiment the counting device is programmed to count down from a number equal to a desired predetermined footage or web length which is stored in the load register.

As the center drum 22 rotates, the encoder 44 produces pulses which are input by way of the input signal 44″ to a counter 62. When the counter 62 reaches a predetermined count J, which is equal to a predetermined sheet or web length, a decision circuit 8 provides an interrupt signal on the output 72, the YES output of the decision circuit 68. Between times, the NO output at 70 is effective so that the decision circuit 68 does not produce an interrupt signal. The counter 62 resets itself upon the production of each interrupt signal and continues to count.

During the time that the counter 62 is counting the input signals 44″, the respective other counting devices are counting the input signals 46″–56″. Upon occurrence of the interrupt signal, the respective load registers cause the counters to be set to a predetermined number and the counters store the respective counts in the hold registers. In this example, the load registers set the respective counters to zero as the hold registers take on the accumulated counts.

As shown in FIG. 3, the hold registers (except the upper hold register) are each connected to a respective buffer 74 which may be a part of or an expansion of a computer memory 76. The information stored in the buffers is fed to calculation circuits 82 which has constants and a program provided thereto by way of portions 78 and 80 of the overall memory 76. From this data, the calculation circuits 82 calculate the density of each roll for display and storage as indicated at 84.

Figure 4:
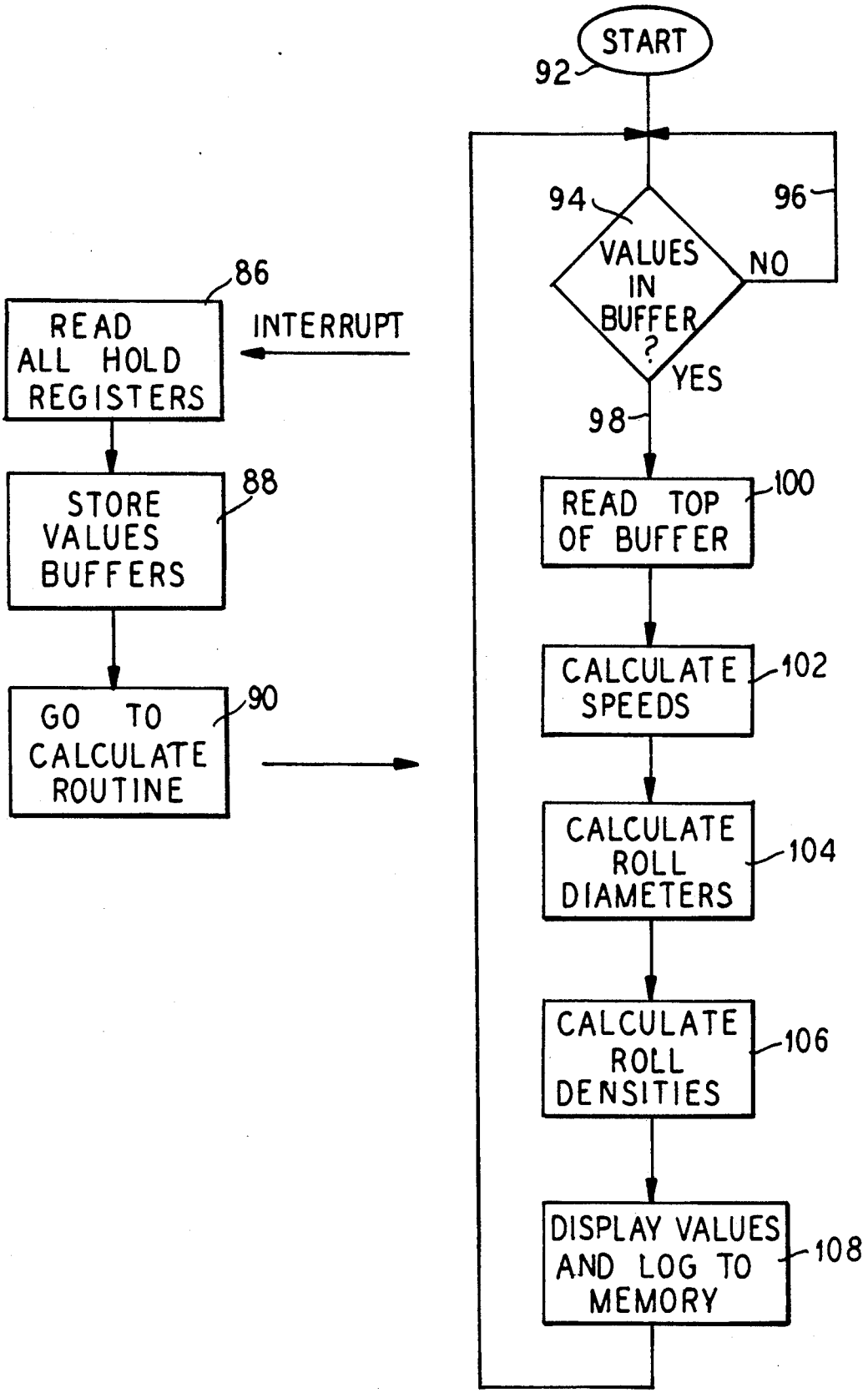
FIG. 4 is a flow chart of the routine used for processing information to determine roll density.

A flow chart is provided in FIG. 4 which parallels the structure illustrated in FIG. 3. As seen in FIG. 4, an interrupt signal effects reading of all hold registers as indicated at 86, storage of the values of the hold registers as indicated at 88, and an initiation of calculations as indicated at 90, before the computer returns to its other tasks. The main routine starts at 92 in which a decision is made at 94 as to whether the values have been stored. If the values have not been stored, the NO output 96 loops back to the input of the decision circuit. If all the values have been stored, the YES output is effective at 98 and the buffers are read as indicated at 100. The information from the buffers is combined with the information stored at 78 and 80 to calculate the speeds, roll diameters and roll densities as indicated at 102, 104 and 106. The resulting values are then displayed as indicated at 108 and, if saved, are logged to memory.

In the present example, the constants stored at 80 are

| | |
|---|---|
| Uwppr | (Unwind counts/rev) |
| Drrp | (Drum Counts/rev) |
| S1ppr | (Station counts/rev) |
| S*ppr | (Other station counts/rev) |
| Ddia | (Drum diameter) |
| Bw | (Basis weight) |
| pi | (3.1416). |

Variables encountered in the present example are

| | |
|---|---|
| Uwct | (Unwind counts) |
| Dct | (Drum counts) |
| S1ct | (Station counts) |
| S*ct | (Other station counts) |
| T | (Incremental time) |

In calculating the densities, it is necessary to calculate other information and includes the calculation of

| | |
|---|---|
| Udia | (Unwind diameter) |
| S1dia | (Station diameter) |
| S*dia | (Other station diameters) |

-continued

| | |
|---|---|
| Fpm | (Speed feet/min) |
| Ft | (Footage paper) |
| S1dens | (Station density) |
| S*dens | (Other station densities) |
| Uwdens | (Unwind density) |

As indicated, the incremental time (T) is provided by the CTM-05 circuit.

Footage is calculated from the expression $$Ft = pi\ (Ddia)\ (Dct)\ /\ (Dppr).$$

Although it is not necessary to calculate the speed in order to determine density, speed is calculated for other purposes from the expression $$Fpm = pi\ (Ddia)\ (Dct)\ /\ (T)\ (Dppr).$$

The diameters are calculated from the expressions $$Uwdia = (Ddia)\ (Dct)\ (Uwppr)/(Uwct)(Dppr) \text{ and}$$

$$Sldia = (Ddia)\ (Dct)\ (Slppr)/(Slct)(Dppr),$$

where the station number * may be employed for the character 1 in the latter equation for each of the other stations 2-K, here 2-5.

The unwind and station densities are then calculated from the expressions $$Uwdens = (Bw)(Ft)\ (4)\ /\ pi\ (Uwdia^2_{n+1} - Uwdia^2_n),$$

and $$Sldens = (Bw)\ (Ft)\ (4)/\ pi\ (Sldia^2_{n+1} - Sldia^2_n).$$

In the latter two equations the number (4) appears because of $\pi/4$ relating to the constant for an area of a circle.

In contrast to U.S. Pat. No. 4,594,880, where a counter is decremented to provide an approximation of the same time interval between successive determinations in order to provide a determination of roll density at intervals based on a substantially constant length of paper wound onto a roll, the present invention provides for the determination of roll density for constant lengths of paper being wound onto a roll or a plurality of constant lengths of paper being wound onto respective rolls. All of the calculated different information, such as speed, footage, diameter and density may be displayed and/or logged to memory.

Ordinarily, the computer is handling other tasks and an interrupt signal at an interrupt level of the computer only takes the computer away from these tasks for a short time. The information incoming from the encoders is relatively slow, for example on the order of 2 or 3 kHz, while the frequency response of the counters is on the order of 7 MHz. The computer must therefore service the interrupt at a far slower rate. In other words, the information is available to the computer and for a relatively long period of time must only be read prior to the next interrupt.

Although I have described my invention by reference to a particular illustrative embodiment thereof, many changes and modifications of the invention may become apparent tho those skilled in the art without departing from the spirit and scope of the invention. I therefore intend to include within the patent warranted hereon all such changes and modifications as may reasonably and properly be included within the scope of my contribution to the art.

I claim:

1. In combination with a computer which is programmed to compute paper web density, in response to an interrupt signal, of a paper roll from angular rotation of the roll as a web of paper is unwound from an unwind roll engaged and guided by a center drum and wound on a windup roll, apparatus comprising:

a first encoder coupled to the center drum and operating to produce first pulses upon each revolution of the center drum;

first counting means connected to said computer and to said first encoder for counting said pulses and producing an interrupt signal for the computer each time said first counting means reaches a predetermined count;

a second encoder coupled to the windup roll and operating to produce second pulses upon each revolution of the windup roll;

second counting means connected to said first counting means and to said second encoder, said second counting means counting said second pulses and being reset upon occurrence of the interrupt pulses; and a register connected to said second counting means for storing the current count thereof upon occurrence of an interrupt signal and connected to the computer to be read after the occurrence of an interrupt signal.

2. The combination of claim 1, and further comprising:

display means connected to said computer and operating to provide a visual display of paper web density.

3. In combination with a computer which is programmed to compute paper web density, in response to an interrupt signal, of a plurality of paper rolls as a plurality of webs are engaged and guided by a first roll and wound on respective windup rolls, apparatus comprising:

a first encoder coupled to a first roll and operate to provide first pulses upon each revolution of the first roll;

a plurality of second encoders, each of said second encoders coupled to a respective windup roll and operating to produce respective second pulses upon each revolution of the respective windup rolls;

a first counting means connected to said first encoder and operating to produce an interrupt signal each time said first counting means reaches a predetermined count;

a plurality of registers each associated with a respective windup roll and each connected to the computer; and a plurality of second counting means, each of said second counting means connected to a respective one of said registers and connected to and counting said second pulses of a respective second encoder, each of said second counting means connected to said first counting means and being reset and transferring its count to its respective register in response to the occurrence of an interrupt signal.

4. The combination of claim 3, wherein said first counting means comprises:

a counter coupled to said first encoder; and a decision circuit connected between said first counter and said plurality of second counting means for producing an interrupt signal each time said counter reaches the predetermined count.

5. Apparatus for monitoring paper roll density, comprising:

a rotatable unwind roll having a first web of paper thereon and being unwound therefrom;

a plurality of rotatable windup rolls each receiving and having a respective second web of paper wound thereon;

a slitter operating to divide said first web of paper into said second webs of paper;

a center drum between said slitter and said plurality of windup rolls engaging and guiding each of said second webs to a respective windup roll;

first encoding means coupled to said center drum and operating to produce first pulses for each revolution of said center drum;

a plurality of second encoding means, each of said second encoding means coupled to a respective windup roll and operating to produce respective second pulses for each revolution of the respective windup roll;

first counting means connected to said first encoding means, said first counting means operating to count said first pulses and to reset and produce an interrupt signal each time it counts a predetermined number of said first pulses;

a plurality of second counting means, each of said second counting means connected to a respective second encoding means and operating to count said second pulses produced by the respective second encoding means, each of said second counting means connected to said first counting means and operated to reset upon the occurrence of each of said interrupt signals;

first storage means connected to each of said second counting means for storing the respective count thereof upon occurrence of each of said interrupt signals;

calculating means connected to said first storage means and to said first counting means, said calculating means including second storage means storing roll and paper and angular constants and operated upon each occurrence of said interrupt signal to calculate the web density of each of said windup rolls from the stored counts and stored constants; and display means connected to said calculating means for displaying the calculated web densities.

6. The apparatus of claim 5, and further comprising:

third encoding means coupled to said unwind roll and operating to produce third pulses for each revolution of said unwind rolls;

third counting means connected to said third encoding means for counting said third pulses, said third counting means connected to said first counting means and reset upon the occurrence of an interrupt pulse; and said first storage means connected to and operated to store the current count of said third counting means upon each occurrence of an interrupt pulse, and said calculating means also operating to calculate unwind web density of said unwind roll upon each occurrence of an interrupt pulse.

7. A method for computing paper web density, in response to an interrupt signal, of a paper roll from angular rotation of the roll as a web of paper is unwound from an unwind roll engaged and guided by a center drum and wound on a windup roll, comprising the steps of:

generating first pulses upon each revolution of the center drum;

counting said pulses and producing an interrupt signal each time the count of said first pulses reaches a predetermined count;

generating second pulses upon each revolution of the windup roll;

counting said second pulses until the occurrence of the interrupt pulses;

storing the current count of second pulses upon occurrence of an interrupt signal;

reading the stored counts upon the occurrence of each interrupt signal;

calculating the web density from the read counts and paper and roll constants; and displaying the calculated density.

* * * * *